US009784270B2

(12) United States Patent
Oda et al.

(10) Patent No.: US 9,784,270 B2
(45) Date of Patent: Oct. 10, 2017

(54) TROCHOID PUMP WITH AIR EJECTION PORT

(71) Applicant: MIKUNI CORPORATION, Tokyo (JP)

(72) Inventors: Hiroyuki Oda, Iwate (JP); Takehiko Naiki, Iwate (JP); Yuya Kaiho, Iwate (JP)

(73) Assignee: MIKUNI CORPORATION, Tokyo (JP)

( * ) Notice: Subject to any disclaimer, the term of this patent is extended or adjusted under 35 U.S.C. 154(b) by 56 days.

(21) Appl. No.: 14/910,260

(22) PCT Filed: Aug. 11, 2014

(86) PCT No.: PCT/JP2014/071162
§ 371 (c)(1),
(2) Date: Feb. 5, 2016

(87) PCT Pub. No.: WO2015/022929
PCT Pub. Date: Feb. 19, 2015

(65) Prior Publication Data

US 2016/0186753 A1 Jun. 30, 2016

(30) Foreign Application Priority Data

Aug. 12, 2013 (JP) ..... 2013-167303

(51) Int. Cl.
*F04C 13/00* (2006.01)
*F04C 15/06* (2006.01)
(Continued)

(52) U.S. Cl.
CPC ..... *F04C 15/06* (2013.01); *F04C 2/10* (2013.01); *F04C 2/103* (2013.01); *F04C 13/001* (2013.01); *F04C 13/007* (2013.01)

(58) Field of Classification Search
CPC ..... F04C 13/001; F04C 13/007; F04C 15/06; F04C 2/10; F04C 2/103
(Continued)

(56) References Cited

U.S. PATENT DOCUMENTS

2005/0019196 A1* 1/2005 Enzaka ..... F04C 15/06 418/206.4
2015/0037181 A1* 2/2015 Hoppach ..... F04C 2/10 417/423.8
(Continued)

FOREIGN PATENT DOCUMENTS

JP H4-65914 6/1992
JP H9-203308 8/1997
(Continued)

OTHER PUBLICATIONS

"International Search Report (Form PCT/ISA/210) of PCT/JP2014/071162", mailed on Nov. 11, 2014, with English translation thereof, pp. 1-3.

*Primary Examiner* — Mark Laurenzi
*Assistant Examiner* — Dapinder Singh
(74) *Attorney, Agent, or Firm* — Jianq Chyun IP Office

(57) ABSTRACT

An air ejection port for ejecting air-mixed oil is structured with a first air ejection port provided on the inner peripheral side from an inscribed circle of an outer rotor and a second air ejection port provided on the outer peripheral side from a circumscribed circle of the inner rotor, the air ejection port can have an enlarged port area as the total of area of the first air ejection port and area of the second air ejection port in a state without being in communication with either of a suction port and a discharge port, and a disadvantage that a pump chamber of a previous stroke and a pump chamber of a subsequent stroke communicate with each other through the air ejection port can be avoided.

2 Claims, 7 Drawing Sheets

(51) Int. Cl.
*F04C 2/00* (2006.01)
*F04C 2/10* (2006.01)

(58) Field of Classification Search
USPC ..... 418/166, 191, 206.1, 229
See application file for complete search history.

(56) References Cited

U.S. PATENT DOCUMENTS

2015/0219097 A1* 8/2015 Torii ..... F04C 2/102
418/205
2015/0337835 A1* 11/2015 Sakata ..... F04C 15/0026
418/116
2015/0354564 A1* 12/2015 Takahashi ..... F04C 14/18
418/19

FOREIGN PATENT DOCUMENTS

JP 2011-231772 11/2011
WO 2013/115292 8/2013

* cited by examiner

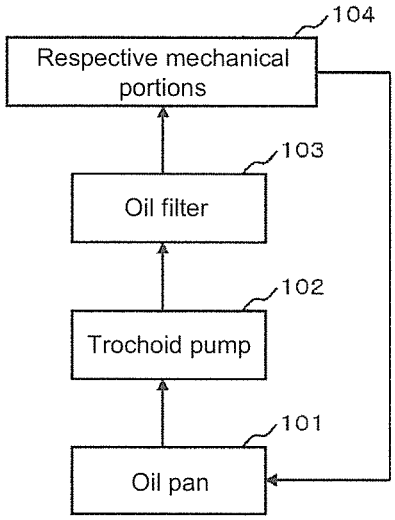
FIG. 8
(RELATED ART)
FIG. 9(a)
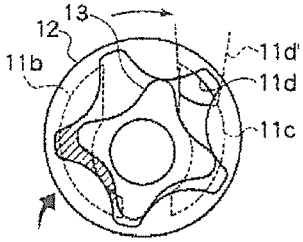
FIG. 9(b)
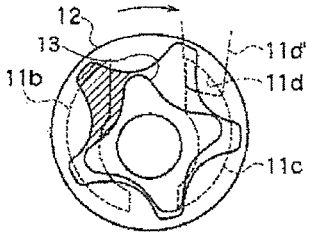
FIG. 9(c)
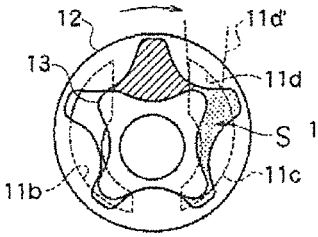
FIG. 9(d)
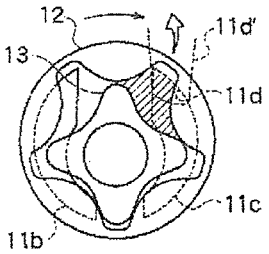
FIG. 9(e)
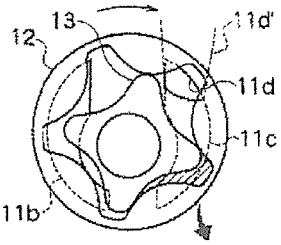
(RELATED ART)

TROCHOID PUMP WITH AIR EJECTION PORT

CROSS-REFERENCE TO RELATED APPLICATION

This application is a 371 application of the international PCT application serial no. PCT/JP2014/071162, filed on Aug. 11, 2014, which claims the priority benefit of Japan application no. JP 2013-167303, filed on Aug. 12, 2013. The entirety of each of the above-mentioned patent applications is hereby incorporated by reference herein and made a part of this specification.

TECHNICAL FIELD

The present invention relates to a trochoid pump with an air ejection port, and in particular, relates to a trochoid pump with an air ejection port preferably used as a trochoid type oil pump that sucks and pressure-feeds oil for supplying to an internal combustion engine (engine), a transmission (gearbox), or the like.

BACKGROUND ART

In general, an internal combustion engine is provided with an oil pump to supply oil from an oil pan arranged at a bottom part of the engine to each mechanical portion thereof arranged at the upper side. In most cases, a trochoid type oil pump (trochoid pump) is used for a four-stroke engine mounted on, for example, a motorcycle, an outboard engine, a snowmobile, or the like (e.g., see Patent Document 1). In some cases, a trochoid pump is used for supplying oil to a transmission or the like.

FIG. 8 illustrates an oil passage using a trochoid pump. As illustrated in FIG. 8, a trochoid pump 102 sucks oil stored in an oil pan 101 arranged at a bottom part of an engine through a suction port and pressurizes and discharges the oil through a discharge port. The oil discharged from the trochoid pump 102 is supplied to a variety of respective mechanical portions 104 through an oil filter 103. Then, the oil is returned to the oil pan 101 from the respective mechanical portions 104.

FIGS. 9(*a*)-9(*e*) are views illustrating operation of the trochoid pump 102. FIGS. 9(*a*)-9(*e*) are disclosed as FIG. 3 in Patent Document 1. FIGS. 9(*a*)-9(*e*) illustrate, for a single pump chamber, a sucking and compressing stroke of air-mixed oil, an ejecting stroke of air and a part of oil, and a discharging stroke of oil. Here, regions filled with oil are illustrated with slashes.

First, when an inner rotor 13 and an outer rotor 12 are rotated clockwise, oil starts to be sucked through a suction port 11*b* as illustrated in FIG. 9(*a*). Then, when the inner rotor 13 and the outer rotor 12 are further rotated clockwise, oil is further sucked as illustrated in FIG. 9(*b*).

Next, the air ejecting stroke starts from a state in which oil is sucked at a maximum as illustrated in FIG. 9(*c*). Accordingly, as illustrated in FIG. 9(*d*), the pump chamber starts to communicate with an ejection port 11*d*, and a part of air-mixed oil is ejected from the ejection port 11*d* through a passage 11*d*'.

When the inner rotor 13 and the outer rotor 12 are further rotated clockwise, the ejection port 11*d* is closed and the discharging stroke starts. In the discharging stroke, as illustrated in FIG. 9(*e*), remaining oil is discharged through a discharge port 11*c* and pressure-fed toward the variety of respective mechanical portions 104.

Here, as illustrated in FIG. 9(*c*), the maximum volume of oil to be discharged through the discharge port 11*c* corresponds to a region of oil S compressed in the previous stroke. Such a technology to eject air mixed in oil by arranging an ejection port that communicates with the outside of a pump is also disclosed, for example, in Patent Document 2.

Patent Document 1: Japanese Patent Application Laid-Open No. 2011-231772

Patent Document 2: Japanese Patent Application Laid-Open No. H9-203308

As disclosed in Patent Document 1 and Patent Document 2, in a conventional trochoid pump, an air ejection port is arrange between a suction port and a discharge port to set an air ejecting stroke between a sucking stroke and a discharging stroke. Generally, in an internal gear pump such as a trochoid pump, oil and mixed air tend to be separated with the oil being at the outer side due to centrifugal force caused by rotation of an outer rotor and inner rotor and the mixed air being at the inner side. Therefore, an air ejection effect can be enhanced by arranging an air ejection port at the inner side.

However, if an air ejection port is arranged large simply at the inner side, the air ejection port communicates with the suction port and air is sucked with negative suction pressure through the air ejection port. Alternatively, the air ejection port communicates with the discharge port and discharge pressure leaks to the air ejection port. Thus, when the air ejection port communicates with either the suction port or the discharge port, a desired amount of oil cannot be sucked and discharged at desired pressure resulting in pumping function deterioration. Therefore, an air ejection port cannot be arranged large simply at the inner side.

As described above, since an air ejection port is required to be arranged at a limited space between a suction port and a discharge port, it has been difficult to ensure port area thereof. Accordingly, there has been a problem that an air ejection effect is difficult to be enhanced with small port area. For some applications, there may be a case that an ejection rate of air-contained oil is required to be a given value or higher. Then, there has been a case that port area cannot be ensured for actualizing the ejection rate of air-contained oil. In addition, such small port area of an air ejection port has been causing a problem that a torque required for rotating a rotor rotating shaft is increased due to enlarged ejection resistance.

To solve such problems, if an air ejection port 220 is designed to be excessively large at a position without having communication with either of a suction port 210 and an discharge port 230 as illustrated in FIG. 10, a pump chamber 240 of a previous stroke and a pump chamber 250 of a subsequent stroke communicate with each other through the air ejection port 220. (In FIG. 10, the rotors are illustrated to be rotated counterclockwise.) As a result, an ejection amount of air-contained oil ejected from the air ejection port 220 cannot be maintained at constant and the discharge amount and discharge pressure of oil fluctuate, resulting in causing a problem that a stable performance of the trochoid pump cannot be obtained.

SUMMARY

To solve the abovementioned problems, an object of the present invention is to enhance an air ejection effect and reduce a torque of a rotor rotating shaft by enlarging port area of an air ejection port in a state that the air ejection port does not communicate with either of a suction port and a discharge port while preventing communication between a pump chamber of a previous stroke and a pump chamber of a subsequent stroke.

To solve the abovementioned problems, the present invention provides a trochoid pump with an air ejection port, including: a suction port through which oil is sucked in a sucking stroke, the air ejection port through which a part of air-mixed oil is ejected in an air ejecting stroke subsequent to the sucking stroke, and a discharge port through which oil is discharged in a discharging stroke subsequent to the air ejecting stroke, wherein the air ejection port including: a first air ejection port provided on an inner peripheral side from an inscribed circle of an outer rotor, and a second air ejection port provided on an outer peripheral side from a circumscribed circle of an inner rotor.

According to the present invention structured as described above, it is possible to arrange the first air ejection port and the second air ejection port in a state without being in communication with either of the suction port and the discharge port and to enlarge port area of the air ejection port as the total area of the first air ejection port and the second air ejection port. Further, since large port area is ensured by the two air ejection ports separately arranged at different positions instead of enlarging area of a single air ejection port, it is possible to avoid a problem that a pump chamber of a previous stroke and a pump chamber of a subsequent stroke communicate with each other through the air ejection port. Thus, the air ejection port can have large port area without communication with either of the suction port and the discharge port and without causing a pump chamber of a previous stroke and a pump chamber of a subsequent stroke to communicate with each other. Accordingly, it is possible to enhance the air ejection effect and reduce the torque of the rotor rotating shaft.

BRIEF DESCRIPTION OF THE DRAWINGS

FIG. 8 is a block diagram illustrating an oil passage using a trochoid pump.

FIGS. 9(*a*)-9(*e*) are views for explaining operation of a conventional trochoid pump.

EMBODIMENT OF THE INVENTION

Figure 1:
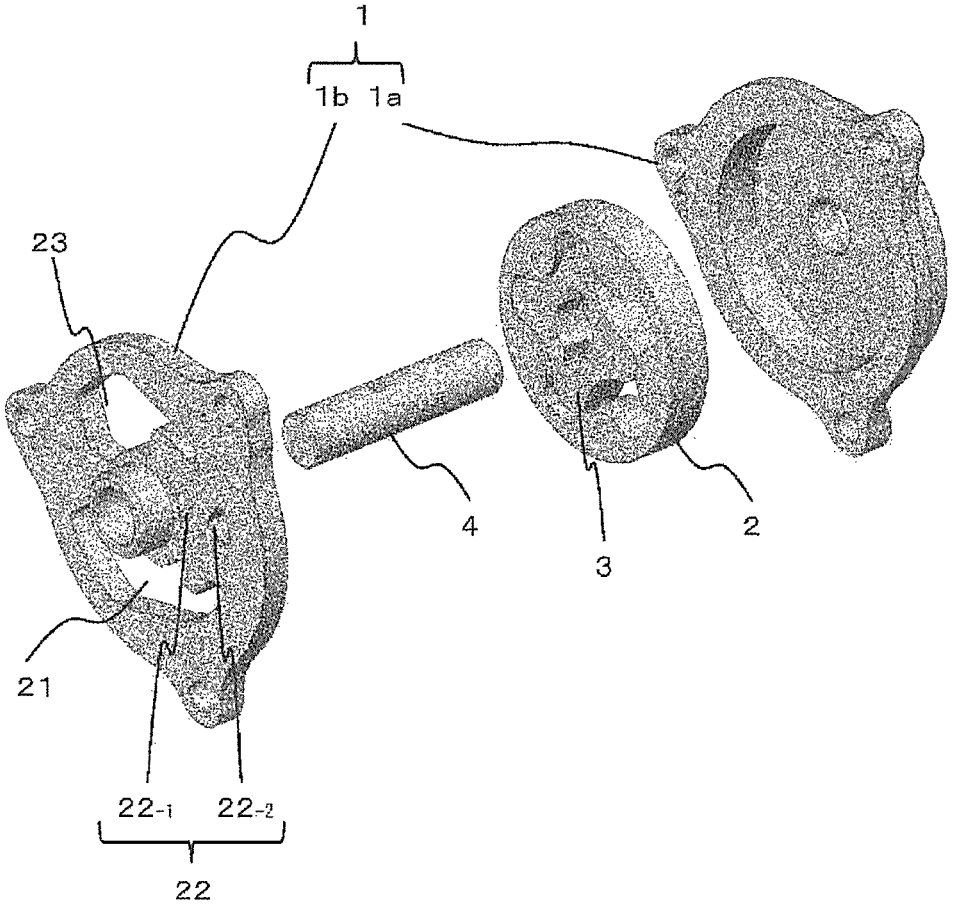
FIG. 1 is an exploded perspective view illustrating a structural example of a trochoid pump with an air ejection port according to an embodiment.
Figure 2:
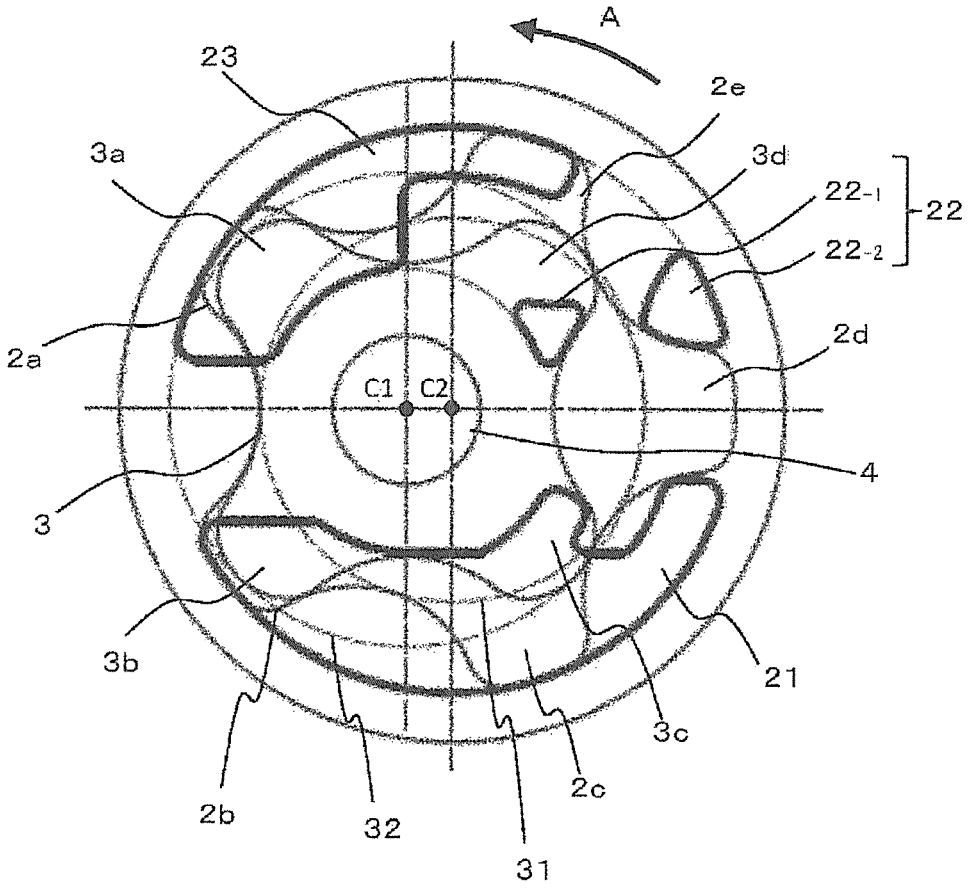
FIG. 2 is a plane view illustrating the structural example of the trochoid pump with an air ejection port according to the embodiment.

In the following, an embodiment of the present invention will be described with reference to the attached drawings. FIG. 1 is an exploded perspective view illustrating a structural example of a trochoid pump with an air ejection port according to the embodiment. FIG. 2 is a plane view illustrating the structural example of the trochoid pump with an air ejection port according to the present embodiment.

As illustrated in FIG. 1, the trochoid pump with an air ejection port according to the present embodiment includes: a casing 1 having a body 1*a* and a cover 1*b*, an outer rotor 2 rotatably arranged in the casing 1, an inner rotor 3 rotatably arranged inside the outer rotor 2 to perform sucking and pressure-feeding of oil in cooperation with the outer rotor 2, and a shaft 4 being a rotating shaft for the outer rotor 2 and the inner rotor 3.

As illustrated in FIG. 2, the inner rotor 3 includes four convex portions 3*a* to 3*d* and is supported to be rotatable about an axis line C1 in a direction of arrow A as being directly connected to the shaft 4. The outer rotor 2 includes five concave portions 2*a* to 2*e* to be engaged with the convex portions 3*a* to 3*d* of the inner rotor 3 and is slidably fitted to and supported by a cylindrical face of the body 1*a* to be rotatable about an axis line C2 in the direction of arrow A. That is, the trochoid pump with an air ejection port of the present embodiment is a trochoid pump having four blades and five nodes.

The cover 1*b* of the casing 1 is provided with a suction port 21 through which oil is sucked in a sucking stroke, an air ejection port 22 through which a part of air-mixed oil is ejected in an air ejecting stroke subsequent to the sucking stroke, and a discharge port 23 through which oil is discharged in a discharging stroke subsequent to the air ejecting stroke.

Here, the air ejection port 22 includes a first air ejection port $\mathbf{22}_{-1}$ arranged on an inner peripheral side from an inscribed circle 31 of the outer rotor 2, and a second air ejection port $\mathbf{22}_{-2}$ provided on an outer peripheral side from a circumscribed circle 32 of the inner rotor 3. It is preferable that the second air ejection port $\mathbf{22}_{-2}$ is arranged at a position being on the outer peripheral side from the circumscribed circle 32 of the inner rotor 3 and being as close as possible to the circumscribed circle 32 (e.g., at a position contacting to the circumscribed circle 32). According to the above, the air ejection port 22 can be arranged in a state that the air ejection port 22 does not communicate with either of the suction port 21 and the discharge port 23 while preventing communication between a pump chamber of a previous stroke and a pump chamber of a subsequent stroke.

Figure 3A:
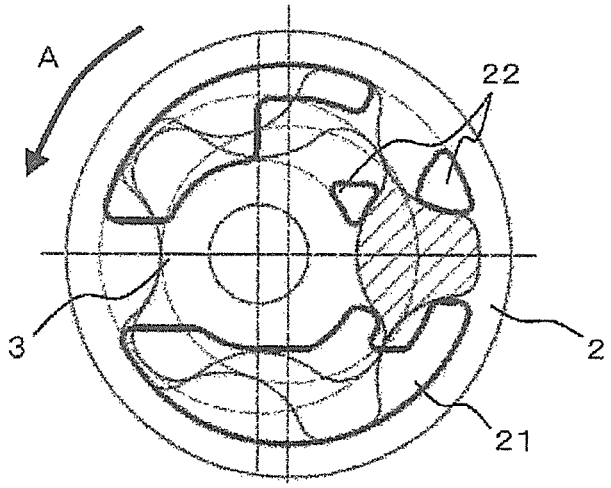
FIGS. 3(*a*)-3(*c*) are views illustrating an operational example of the trochoid pump with an air ejection port according to the embodiment.
Figure 3B:
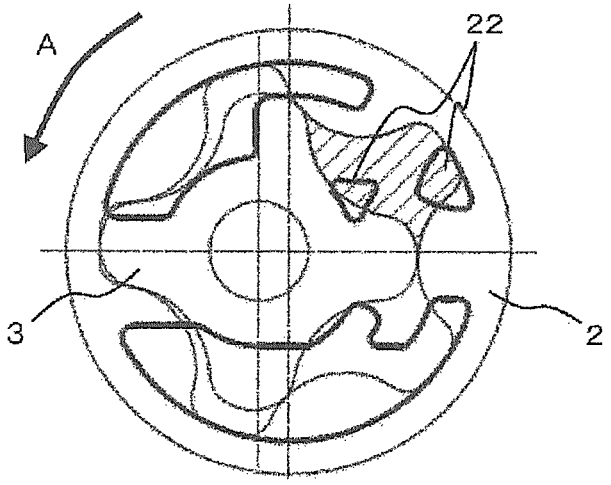
Figure 3C:
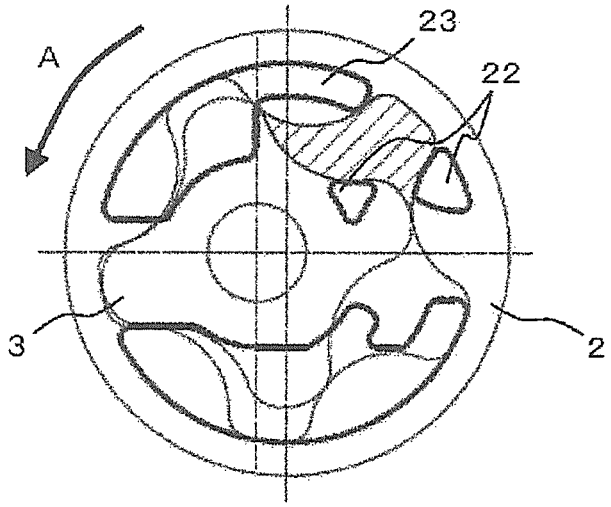

FIGS. 3(*a*)-3(*c*) are views illustrating an operational example of the trochoid pump with an air ejection port according to the present embodiment. FIG. 3(*a*) illustrates a state that the sucking stroke completes, FIG. 3(*b*) illustrates a state of the air ejecting stroke, and FIG. 3(*c*) illustrates a state that the air ejecting stroke completes. In FIGS. 3(*a*)-3(*c*), the respective states are illustrated for a single pump chamber and regions filled with oil are illustrated with slashes.

First, in the sucking stroke, owing to that the outer rotor 2 and the inner rotor 3 are rotated in the direction of arrow A (counterclockwise), oil is sucked through the suction port 21. FIG. 3(*a*) illustrates a state the sucking stroke completes (i.e., a state just before the air ejecting stroke starts).

In the state illustrated in FIG. 3(*a*), the pump chamber does not communicate with either of the suction port 21 and the air ejection port 22 and the volume thereof is the maximum. For increasing the maximum volume of the pump chamber to the extent possible, it is preferable that the air ejection port 22 is formed to have a shape and to be at a position so that a face of the pump chamber on the side of the air ejection port 22 come close to the air ejection port 22 at the time when the sucking stroke completes.

Next, as illustrated in FIG. 3(*b*), when the outer rotor 2 and the inner rotor 3 are further rotated counterclockwise from a state in which oil is sucked at a maximum, the air ejecting stroke starts and the pump chamber communicates with the air ejection port 22. Accordingly, a part of air-mixed oil is ejected through the air ejection port 22.

When the outer rotor 2 and the inner rotor 3 are further rotated counterclockwise, the air ejection port 22 is closed and the discharging stroke starts. In the discharging stroke, remaining oil is discharged through the discharge port 23. FIG. 3(*c*) illustrates the state that the air ejecting stroke completes, that is, the state just before the discharging stroke starts. In the state illustrated in FIG. 3(*c*), the pump chamber does not communicate with either of the air ejection port 22 and the discharge port 23 and the volume of the pump chamber is smaller than the maximum volume illustrated in FIG. 3(*a*).

The ejection rate (%) of air-contained oil is calculated as "(CP1−CP2)/CP1×100". Here, CP1 represents the volume of the pump chamber before the air ejecting stroke starts as illustrated in FIG. 3(*a*) and CP2 represents the volume of the pump chamber after the air ejecting stroke completes as illustrated in FIG. 3(*c*). FIGS. 3(*a*)-3(*c*) illustrate a case that the ejection rate of air-contained oil is 20%.

Figure 4:
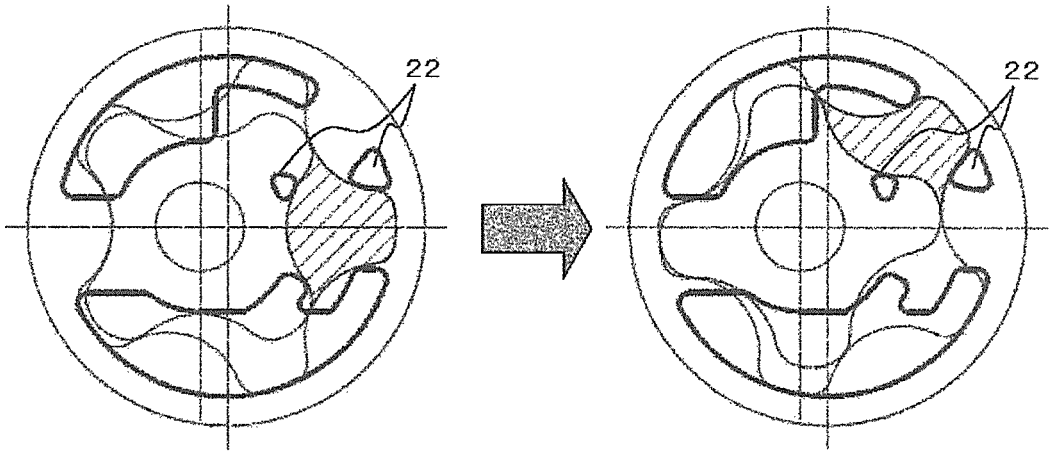
FIG. 4 is a plane view of another structural example of an air ejection port of the trochoid pump with the air ejection port according to the embodiment.
Figure 5:
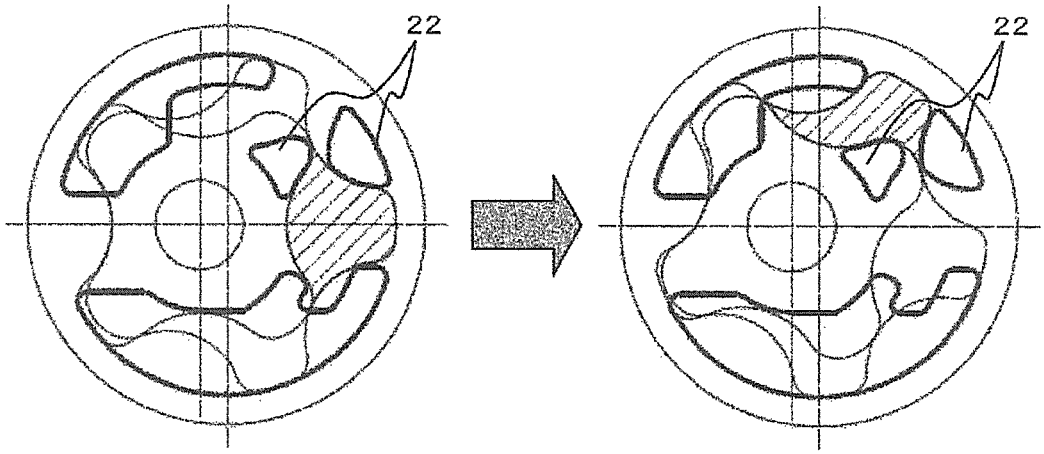
FIG. 5 is a plane view of another structural example of an air ejection port of the trochoid pump with the air ejection port according to the embodiment.

It is possible to adjust the ejection rate of air-contained oil by changing a size, a position, and a shape of the air ejection port 22 (the first air ejection port $\mathbf{22}_{-1}$ and the second air ejection port $\mathbf{22}_{-2}$). FIG. 4 illustrates a structural example of the air ejection port 22 in a case that the ejection rate of air-contained oil is set to 15%. FIG. 5 illustrates a structural example of the air ejection port 22 in a case that the ejection rate of air-contained oil is set to 25%.

Figure 6:
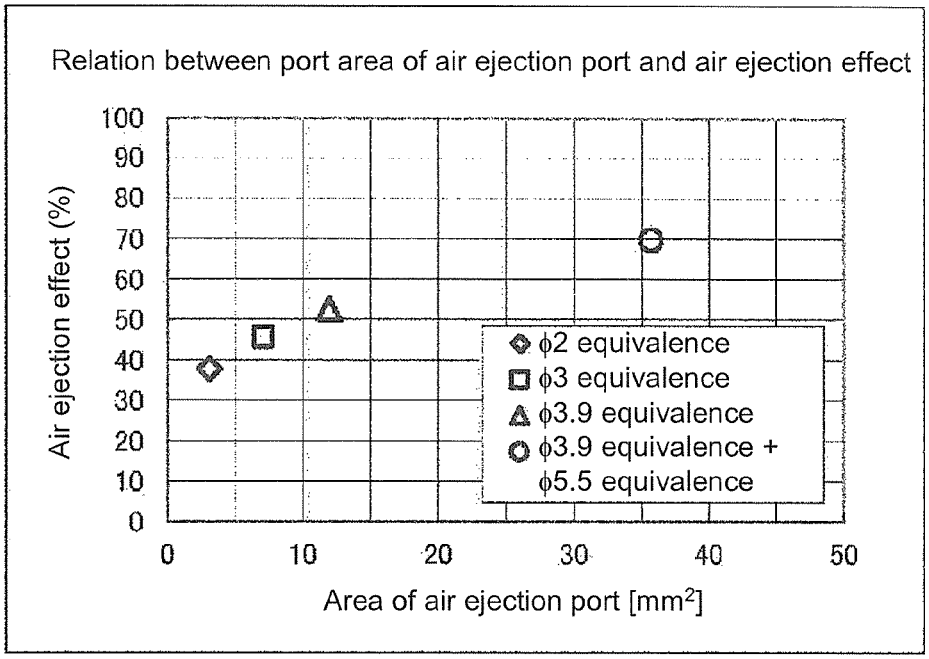
FIG. 6 is a graph indicating an air ejection effect of the trochoid pump with an air ejection port according to the embodiment.

FIG. 6 is a graph indicating an air ejection effect of the trochoid pump with an air ejection port according to the present embodiment. The air ejection effect denotes a ratio between an air-containing rate of oil before the air ejecting stroke and an air-containing rate of oil discharged through the discharge port 23 after the air ejecting stroke. The air ejection effect can be calculated as follows.

> "(1−(an air containing rate of discharged oil from a trochoid pump with an air ejection port)/(an air containing rate of discharged oil from a trochoid pump without an air ejection port))×100"

FIG. 6 indicates the air ejection effect when the ejection rate of air-contained oil is set to 20% with a ϕ54 rotor. Symbols "◇", "□", "Δ" indicate air ejection effects in the conventional art each provided with only a single air ejection port having different port area (ϕ2 equivalence, equivalence, ϕ3.9 equivalence). In contrast, symbol "○" indicates an air ejection effect in a case that the first air ejection port $\mathbf{22}_{-1}$, (ϕ3.9 equivalence) and the second air ejection port $\mathbf{22}_{-2}$ (ϕ5.5 equivalence) are arranged as the present embodiment.

As illustrated in FIG. 6, even in the conventional art, the air ejection effect can be enhanced to some extent by enlarging port area of the air ejection port. However, there is a limit on enlarging port area of a single air ejection port in a state that the air ejection port does not communicate with either of a suction port and a discharge port while preventing communication between a pump chamber of a previous stroke and a pump chamber of a subsequent stroke. That is, there is a limit on enhancing the air ejection effect. Symbol "Δ" indicates a vicinity of the limit.

In contrast, when the first air ejection port $\mathbf{22}_{-1}$ and the second air ejection port $\mathbf{22}_{-2}$ are arranged as the present embodiment, port area of the air ejection port 22 (the total area of the first air ejection port $\mathbf{22}_{-1}$ and the second air ejection port $\mathbf{22}_{-2}$) can be enlarged, as indicated by symbol "○", in a state that the air ejection port 22 does not communicate with either of the suction port 21 and the discharge port 23 while preventing communication between a pump chamber of a previous stroke and a pump chamber of a subsequent stroke. Accordingly, the air ejection effect can be enhanced compared to the conventional case.

The test result of FIG. 6 indicates that an air ejection effect can be obtained even when the air ejection port 22 is provided on the outer peripheral side from the circumscribed circle 32 of the inner rotor 3. At a region where the suction port 21 and the air ejection port 22 are not concurrently opened as well as the discharge port 23 and the air ejection port 22 are not concurrently opened, the air ejection port 22 is divided and arranged at a position being on the inner peripheral side from the inscribed circle 31 of the outer rotor 2 and a position being on the outer peripheral side from the circumscribed circle 32 of the inner rotor 3. According to the above, the air ejection effect can be enhanced without deteriorating pumping performance.

Figure 7:
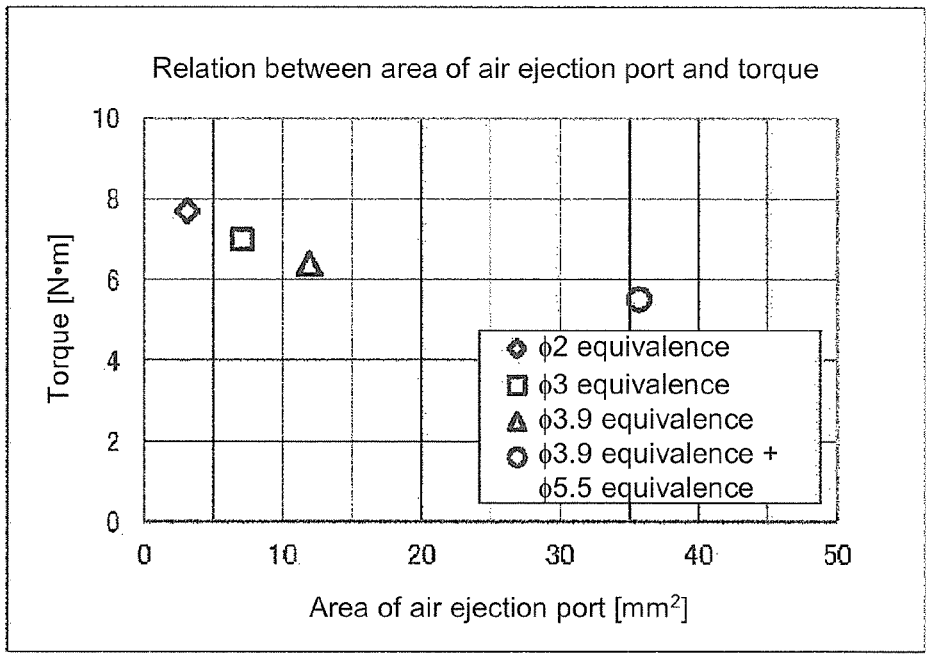
FIG. 7 is a graph indicating a torque of a rotor rotating shaft of the trochoid pump with an air ejection port according to the embodiment.
Figure 10:
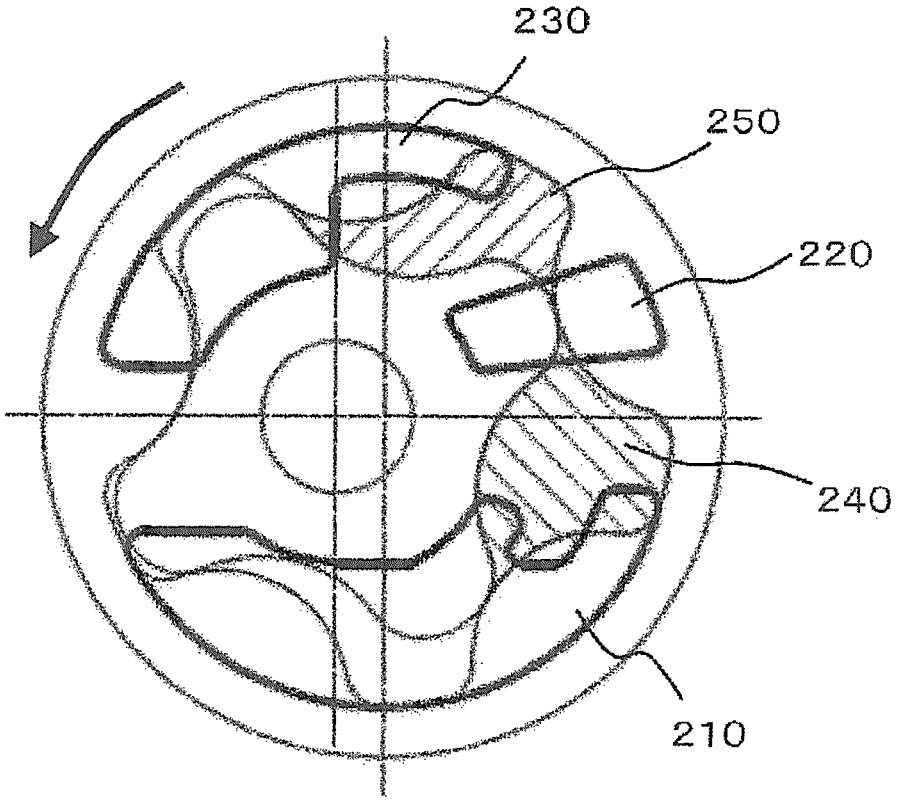
FIG. 10 (RELATED ART)
FIG. 10 is a view for explaining problems of a conventional trochoid pump.

FIG. 7 is a graph indicating a torque of the rotor rotating shaft of the trochoid pump with an air ejection port according to the present embodiment. FIG. 7 indicates the torque when the ejection rate of air-contained oil is set to 20% with a ϕ54 rotor as well. Symbols "◇", "□", "Δ" indicate torques in the conventional art each provided with only a single air ejection port. In contrast, symbol "○" indicates a torque in a case that the first air ejection port $\mathbf{22}_{-1}$ and the second air ejection port $\mathbf{22}_{-2}$ are arranged as the present embodiment.

As illustrated in FIG. 7, even in the conventional art, the torque can be reduced to some extent by enlarging port area of the air ejection port. However, as described above, there is a limit on enlarging port area of a single air ejection port in a state that the air ejection port does not communicate with either of a suction port and a discharge port while preventing communication between a pump chamber of a previous stroke and a pump chamber of a subsequent stroke. Accordingly, there is a limit on reducing the torque. Symbol "Δ" indicates a vicinity of the limit.

In contrast, when the first air ejection port $\mathbf{22}_{-1}$ and the second air ejection port $\mathbf{22}_{-2}$ are arranged at the present embodiment, port area of the air ejection port 22 (the total area of the first air ejection port $\mathbf{22}_{-1}$ and the second air ejection port $\mathbf{22}_{-2}$) can be enlarged, as indicated by symbol "○", in a state that the air ejection port 22 does not communicate with either of the suction port 21 and the discharge port 23 while preventing communication between a pump chamber of a previous stroke and a pump chamber of a subsequent stroke. Accordingly, the torque can be reduced compared to the conventional case. The above result also indicates that air ejection is effectively performed by arranging the first air ejection port $\mathbf{22}_{-1}$ and the second air ejection port $\mathbf{22}_{-2}$.

As described above in detail, in the present embodiment, the air ejection port 22 is formed by the first air ejection port $\mathbf{22}_{-1}$ provided on the inner peripheral side from the inscribed circle 31 of the outer rotor 2 and the second air ejection port $\mathbf{22}_{-2}$ provided on the outer peripheral side from the circumscribed circle 32 of the inner rotor 3. According to the above, it is possible to arrange the first air ejection port $\mathbf{22}_{-1}$ and the second air ejection port $\mathbf{22}_{-2}$ in a state without being in communication with either of the suction port 21 and the discharge port 23 and to enlarge port area of the air ejection port 22 as the total area of the first air ejection port $\mathbf{22}_{-1}$ and the second air ejection port $\mathbf{22}_{-2}$.

Further, in the present embodiment, large port area is ensured by the two air ejection ports $\mathbf{22}_{-1}$, $\mathbf{22}_{-2}$ separately arranged at different positions instead of enlarging area of a single air ejection port as in the conventional art. Accordingly, it is possible to avoid a problem that a pump chamber of a previous stroke and a pump chamber of a subsequent stroke communicate with each other through the air ejection port 22.

Thus, according to the trochoid pump with an air ejection port of the present embodiment, the air ejection port 22 can have enlarged port area without communicating with either of the suction port 21 and the discharge port 23 and without causing a pump chamber of a previous stroke and a pump chamber of a subsequent stroke to communicate with each other. Accordingly, it is possible to enhance the air ejection effect and reduce the torque of the rotor rotating shaft.

The abovementioned embodiment simply describes an example of an embodiment for actualizing the present invention and the technical scope of the present invention should not be construed in a limited manner. That is, the present invention can be actualized variously without departing from the substance or main features thereof.

The invention claimed is:

1. A trochoid pump with an air ejection port, comprising:

a casing;

an outer rotor, rotatably arranged in the casing; and an inner rotor, rotatably arranged inside the outer rotor to perform sucking and pressure-feeding of an oil in cooperation with the outer rotor;

wherein the casing including: a suction port through which the oil is sucked in a sucking stroke, an air ejection port through which a part of air-mixed oil is ejected in an air ejecting stroke subsequent to the sucking stroke, and a discharge port through which the oil is discharged in a discharging stroke subsequent to the air ejecting stroke;

the air ejection port including: a first air ejection port provided on an inner peripheral side from an inscribed circle of the outer rotor, and a second air ejection port provided on an outer peripheral side from a circumscribed circle of the inner rotor.

2. The trochoid pump with an air ejection port according to claim 1, wherein the second air ejection port is arranged at a position close to the circumscribed circle of the inner rotor on the outer peripheral side from the circumscribed circle.

* * * * *